US006895790B2

(12) United States Patent
Jeffries

(10) Patent No.: US 6,895,790 B2
(45) Date of Patent: May 24, 2005

(54) LATCH ASSEMBLY

(75) Inventor: Mark Jeffries, Cumming, GA (US)

(73) Assignee: Austin Hardware & Supply, Inc., Lee's Summit, MO (US)

( * ) Notice: Subject to any disclaimer, the term of this patent is extended or adjusted under 35 U.S.C. 154(b) by 0 days.

(21) Appl. No.: 10/215,849

(22) Filed: Aug. 9, 2002

(65) Prior Publication Data

US 2004/0025547 A1 Feb. 12, 2004

(51) Int. Cl.[7] ..... E05B 13/10

(52) U.S. Cl. ..... 70/208; 70/215; 70/224; 292/139; 292/153; 292/167; 292/DIG. 31

(58) Field of Search ..... 70/208, 215, 221, 70/224; 292/139, 153, 167, DIG. 31

(56) References Cited

U.S. PATENT DOCUMENTS 1,242,943 A * 10/1917 Jackson
2,201,963 A * 5/1940 Wartian
2,232,020 A * 2/1941 Bernhardt
2,642,300 A * 6/1953 Pelcin
3,044,815 A * 7/1962 Soss
3,209,563 A * 10/1965 Pelcin
3,283,549 A * 11/1966 Mees
3,576,118 A * 4/1971 Doerrfeld ..... 70/146
3,584,483 A * 6/1971 Orr ..... 70/81
4,170,119 A * 10/1979 Kalis, Jr. ..... 70/221
4,309,884 A * 1/1982 Davis ..... 70/472
4,638,649 A * 1/1987 Chao ..... 70/71
4,676,081 A * 6/1987 Craig ..... 70/169
4,683,736 A * 8/1987 Weinerman et al. ..... 70/208
4,882,919 A * 11/1989 Craig ..... 70/208
5,121,952 A 6/1992 Jason ..... 292/175
5,158,329 A 10/1992 Schlack ..... 292/87
5,301,989 A * 4/1994 Dallmann et al. ..... 292/142
5,358,291 A 10/1994 Malmanger et al. ..... 292/175
5,482,333 A 1/1996 Gehrs et al. ..... 292/163
5,603,535 A 2/1997 Antonucci et al. ..... 292/128
5,628,534 A 5/1997 Morgan ..... 292/128
5,878,608 A 3/1999 Alyanakian ..... 70/208
5,897,147 A 4/1999 Alyanakian et al. ..... 292/175
5,934,115 A 8/1999 Bernier et al. ..... 70/208
5,934,716 A 8/1999 Koveal et al. ..... 292/175
5,994,842 A 11/1999 Wong ..... 315/76
6,138,484 A * 10/2000 Sauerland et al. ..... 70/78
6,145,352 A * 11/2000 Vickers et al. ..... 70/208
2001/0049950 A1 * 12/2001 Finch ..... 70/208
2003/0150246 A1 * 8/2003 Gladden et al. ..... 70/208

* cited by examiner

*Primary Examiner*—Lloyd A. Gall
(74) *Attorney, Agent, or Firm*—Polsinelli Shalton Welte Suelthaus PC

(57) ABSTRACT

The present invention relates to a latch assembly insert, which includes a housing member, a bolt, a latch member, and a transfer cam. The latch assembly insert is designed so that it can be snap-fit into a cutout or similar hole, and used to hold shut a door, window, or similar member.

17 Claims, 7 Drawing Sheets

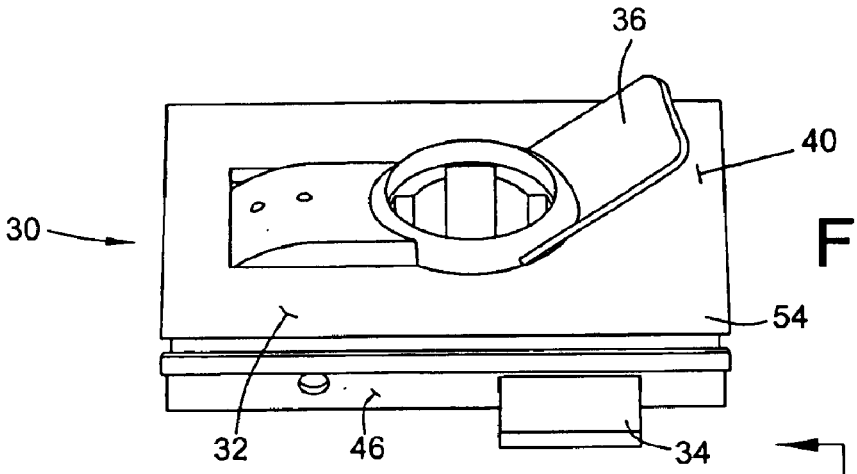
Fig. 1.
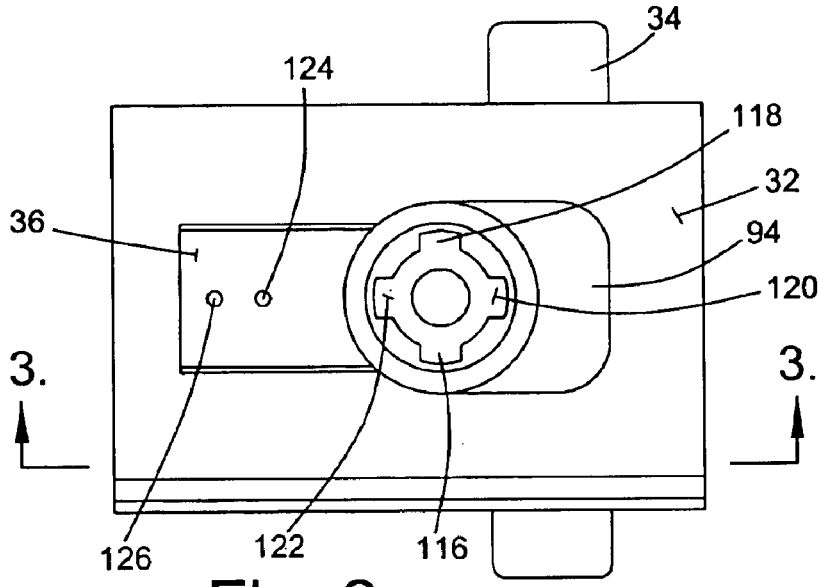
Fig. 2.
Fig. 3.
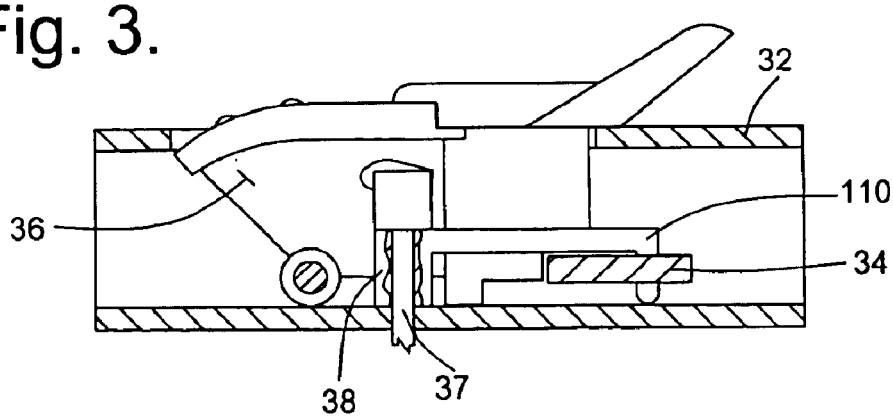

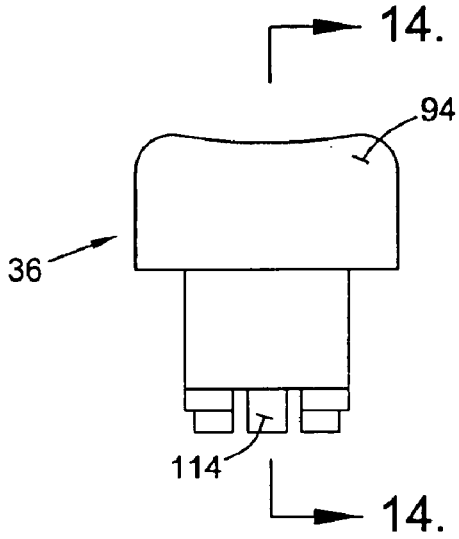
Fig. 12.
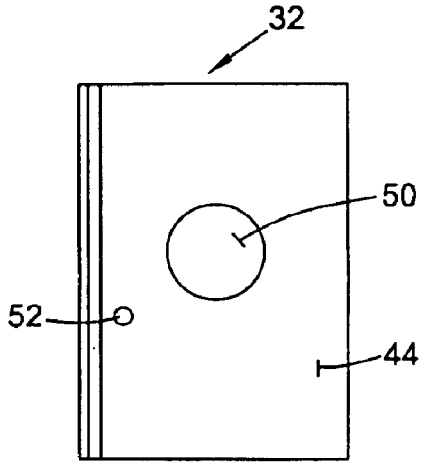
Fig. 13.
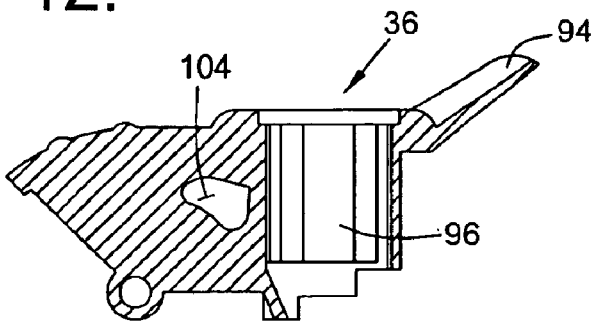
Fig. 14.
Fig. 15.
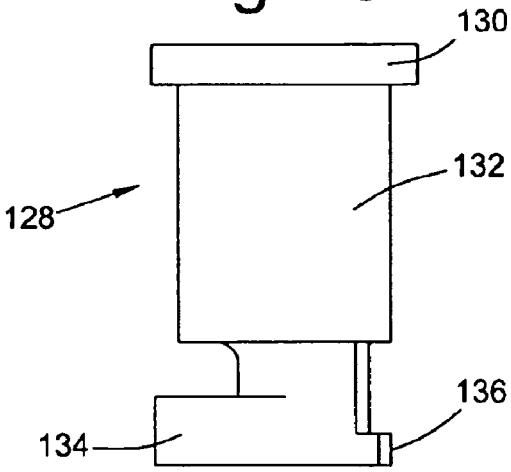
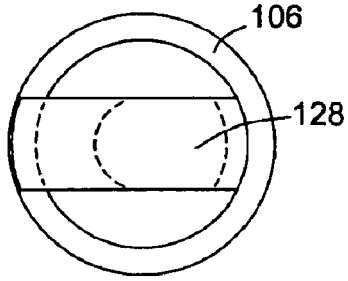
Fig. 16.

LATCH ASSEMBLY

FIELD OF INVENTION

The present invention relates to a latch assembly member, which can be snap-fit into a cutout in a door or window, for example, and can be used to lock or hold closed the window or door. The latch assembly includes a housing member, a latch member, a transfer cam, and a handle member.

BACKGROUND OF INVENTION

Doors, toolboxes, and windows can be latched closed using any of a variety of different mechanisms. These latch mechanisms hold the window, for example, closed when placed in a certain position. Typically, when these latch mechanisms are actuated, they can be moved to a position, whereby the window, door, or toolbox can be opened. As can be gathered, these types of mechanisms can be used in any of a variety of different constructions and devices, with it known to use a latching mechanism in these constructions. The latching mechanism typically works, whereby it is turned to cause a latch, or similar member, to move, allowing the cabinet door or window to be opened or closed.

Most known devices involve the use of a turning mechanism. It is desired, however, to have a device that can be pulled. An advantage of such a device is it requires less space to operate.

Additionally, most of these latch mechanisms have to be fastened or riveted to the door or window. Typically, such fastening, or riveting, requires additional time and parts to accomplish the permanent attachment of the latch device to the door. As such, it is desired to have a device, which can be quickly installed without rivets. Such a device would be advantageous because it would decrease the amount of labor that would be required for attachment and would, presumably, decrease the total overall cost of the device.

SUMMARY OF INVENTION

The present invention relates to a latch assembly for use in a door or window. This latch assembly can be snap-fit into a cutout in the door or window, so that no fastening or riveting is required. The latch assembly includes a housing member, a bolt, a handle, and a transfer cam.

The housing member can be made of any of a variety of materials, such as plastic, metal, wood, or any other material that is rigid enough to be snap-fit into place. The housing member can be of a unitary construction, such as a one-piece extruded construction. Alternatively, the top of the housing member may be removably attached to the housing member. The housing member is designed to be slideably fitted into place, thereby forming a frictional fit between the walls of the cutout and the housing member. This results in the permanent attachment of the housing member into the cutout, without the use of rivets, bolts, or screws.

The bolt is preferably of a rectangular construction, and includes a notch which receives the transfer cam. The bolt is slideably received by two slots located in the side walls of the housing member. The bolt holds the door or window closed until moved by the transfer cam. The bolt can be made of any of a variety of different materials, including plastic, wood, metal, or any other type of rigid material. It can have numerous end configurations. Thus, the bolt can generally be configured to fit a wide variety of uses.

The transfer cam transfers motion from the handle of the device to the bolt, causing the bolt to move linearly. Any device capable of transferring motion can be used as a transfer cam, as long as the handle can be actuated and the bolt can be moved.

The handle is of a unitary construction, and is preferably made of hard plastic. A number of different devices can be used for the handle, as long as the device can pivotally rotate, turn, or slide, house a tumbler lock, and receive and actuate the transfer cam. When the handle is actuated, it moves in a rotary motion. It is helpful if the handle, when in position, projects up and away from the housing member, so that it is easy to grasp the handle in order to rotate it.

BRIEF DESCRIPTION OF DRAWINGS

FIG. 1 is a side perspective view of the latch assembly;

FIG. 2 is a top view of the latch assembly;

FIG. 3 is a side cutaway view of the latch assembly;

FIG. 12 is a back view of the handle member;

FIG. 13 is a bottom view of the housing member;

FIG. 14 is a side cutaway view of the handle member;

FIG. 15 is a side perspective view of the tumbler lock;

FIG. 16 is a top view of the tumbler lock;

DETAILED DESCRIPTION

Figure 4:
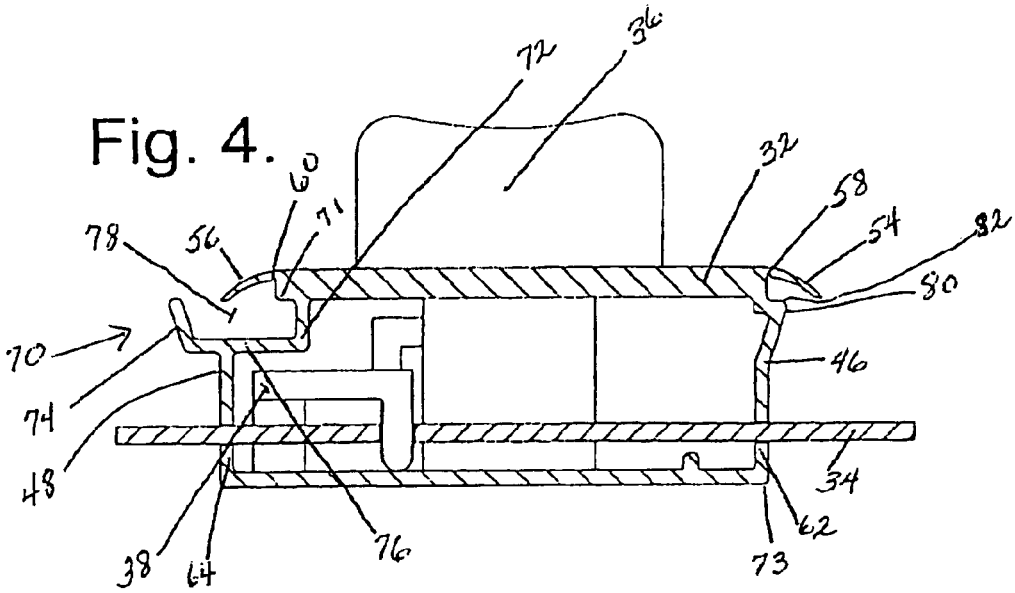
FIG. 4 is a back cutaway view of the latch assembly.

The present invention relates to a latch assembly insert device 30, which can be assembled and placed in an opening located in a door, window, toolbox, or any other similar member, which can be latched and unlatched. In particular, the present invention relates to a pre-assembled latch assembly 30, which is inserted into a cutout and snap-fit into place without the use of rivets, screws, or bolts to hold it in place. The latch assembly 30 is best shown in FIGS. 1, 2, 3, 4, 26, and 27, and includes a housing member 32, a bolt 34, a handle 36, and a transfer cam 38.

The housing member 32, shown by itself in FIGS. 8, 9, 17, 18, and 19, can be of a unitary construction, whereby it is a one-piece extruded construction. The housing member 32 is designed so that it can be placed into a cutout in a door, window, toolbox or similar member, and fixedly attached thereto. In particular, the housing member 32 is designed and dimensioned to be slideably fitted into place so that a frictional fit is formed between the walls or edges of the cutout and the housing member. The frictional fit is such that a permanent attachment occurs, which prevents removal of the housing member 32 from the cutout. Accomplishing this snap-fit requires that the distance from the diagonal corners of the cutout be slightly larger than the distance from the diagonal corners of the housing member. Thus, the distance from corner 71 diagonally across the housing member to corner 73, as shown in FIG. 4, is less than the distance from a corner of the cutout, which corresponds to corner 71 to a corner of the cutout corresponding to corner 73. When the housing member 32 slides into place, the foot 80 slides further under one edge of the cutout so that channel 60 can contact and lock onto the opposite edge of the cutout. This action snap-fits the housing member into place.

In order for the housing member 32 to snap-fit into a cutout in a door, window, toolbox or similar member and fixedly attach thereto, approximately half the area of all of the edges of the outer walls must include a flange running parallel along these edges. Thus, when the housing member is rectangular or square in shape, the flanges can be placed on any two edges of the outer walls of the housing member to allow the housing member to snap-fit into place. As long as at least half of the edges of the outer wall of the housing member include a flange, the housing member will be able to snap-fit into place.

Fastening means, such as bolts or rivets, are not required because the housing member is snap-fit into place. The housing member 32, as well as the other members of the latch assembly 30, can be made from any of a variety of materials, including plastic, metal, wood, and any other rigid material. It is preferred to use plastic because it can be extruded into a one-piece construction, and plastic has a small degree of pliability, which is useful when forming the friction fit.

Figure 9:
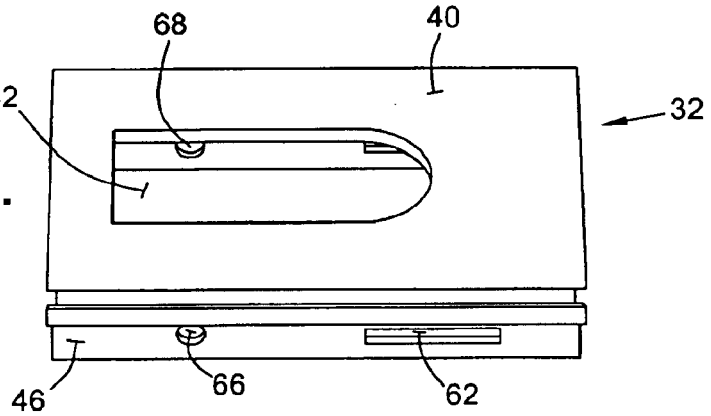
FIG. 9 is a side perspective view of the housing member.
Figure 17:
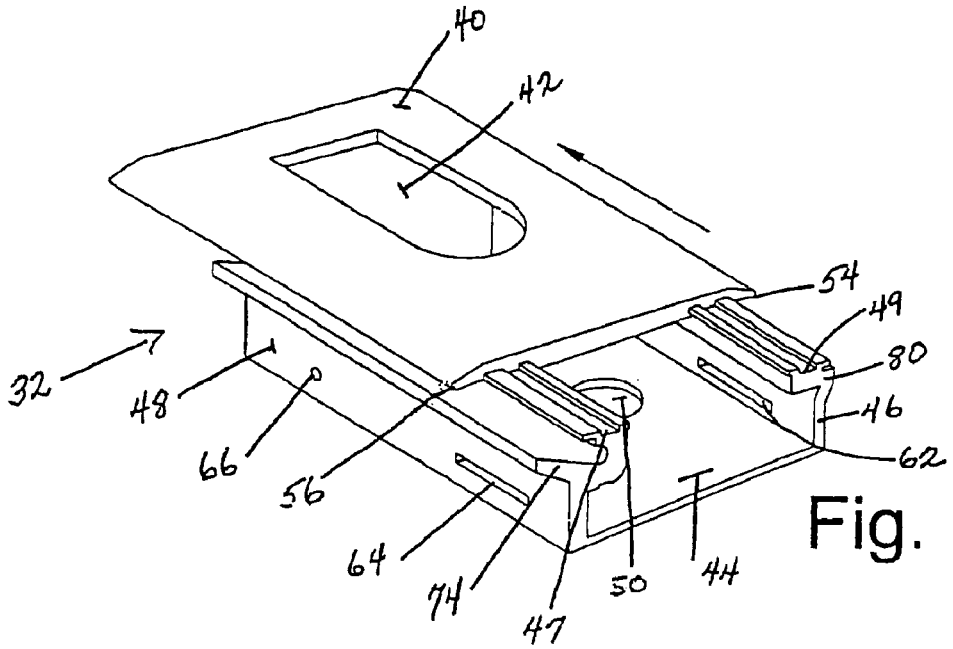
FIG. 17 is a side perspective of the housing member, showing a further embodiment where the top of the housing member is slideably attached to the side walls of the housing member.
Figure 19:
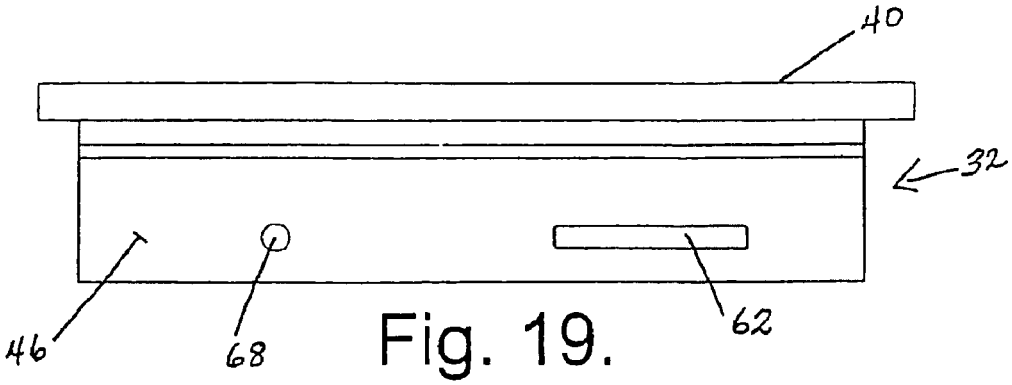
FIG. 19 is a side perspective view of the housing member.

The housing member 32, shown in FIGS. 9 and 19, can include a top face member 40 having an opening 42, a base member 44, and a pair of opposed side walls 46 and 48 attached to the top face 40 and base 44. The housing member must have at least three walls in order to snap-fit into place. Therefore, the housing member can consist of the two side walls 46 and 48 and either the top face member 40 or the base member 44. The housing member 32 generally will have a rectangular construction; however, any other shape can be used, as long as the housing member can be placed into a cutout in a door or window to form a frictional fit there within. The opening in the top face member 40 can be a slot 42, as shown in FIG. 17. The base 44 will preferably be of a rectangular design and will optionally include a pair of holes 50 and 52, as shown in FIG. 13, with one hole 50 designed to allow clearance for the end of a tumbler to fit therein. The latch assembly 30 is of a compact construction. As such, in order for all the parts to be housed within the confines of the housing member 32, it is preferred to cutout part of the housing member to create space. Resultingly, the tumbler hole 50 creates extra space for the end of the tumbler to rest within the diameter of the hole. There is also preferably a pin hole 52, in which a portion of a pin is confined. The transfer cam 38 will rotate on the pin member.

The base 44 and the top 40 of the housing member 32 can be any of a variety of lengths or widths, with it preferred for the length to range between 3 inches and 10 inches, and the width to range between 1 inch and 5 inches. The wall thickness of the base 44 and top face members 40 can be any of a variety of sizes and dimensions, as long as the base and top face can form a frictional fit within a cutout in a door or window.

Figure 18:
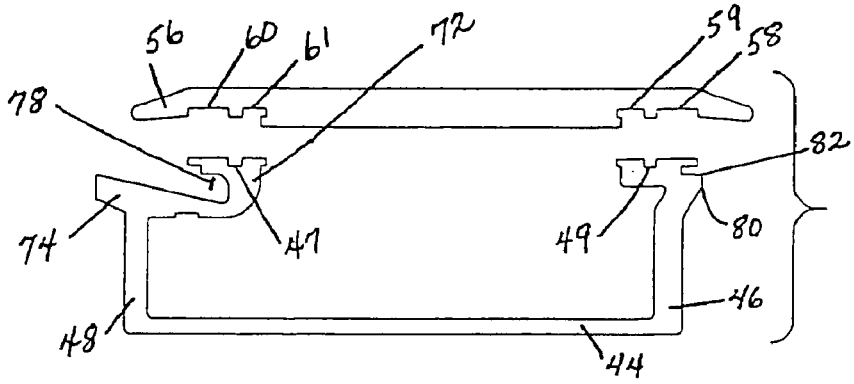
FIG. 18 is a back cutaway perspective view of the embodiment of the housing member, wherein the top is slideably mounted to the side walls of the housing member.

In one embodiment, the top 40 of the housing member 32 is removably attached to the side walls 46 and 48, FIGS. 17 and 18. The top can be slideably attached to the side walls, which are integrally attached to the base member 44. The top 40 includes a pair of parallel flanges 54 and 56, which are integral to the top and can extend the entire length of the top member, as shown in FIGS. 4, 8, 17, and 18. The flanges are of a lesser thickness than the top 40, which allows the flanges to slightly bend to form the friction fit. The flanges preferably slant downward in order to more easily slideably fit into the cutout in a door or window and form a frictional fit within the cutout. Each flange 54 and 56 includes an outer channel 58 and 60. When the top 40 is removably attached to the side walls 46 and 48, the flanges 54 and 56 further include inner channels 59 and 61, respectively, which can extend the length of the flanges, as shown in FIGS. 17 and 18. The top of each side wall 46 and 48 includes a channel 47 and 49, which allow the top member 40 to slideably attach to the top of the side walls when the outer channels 58 and 60, and inner channels 59 and 61 of the top member, slideably engage the channel of each side wall, as shown in FIGS. 17 and 18.

In another embodiment, the top 40 is integrally attached to the side walls 46 and 48. When the top is integrally attached to the side walls, it is not necessary to include a base member in the housing member, FIG. 8. Thus, in this embodiment, the top of the housing member offers a strong enough support to both house the handle and the tumbler lock member, without relying on a base member, and still be frictionally fit into place within a cutout in a door or window.

The top face 40 includes an opening 42 for receiving the handle member. The opening can be an elongated slot 42 having a rounded end, as shown in FIGS. 9 and 17. The slot 42 is designed and dimensioned to receive the handle member 36, whereby the handle can rotate within the confines of the slot.

As previously mentioned, attached on each side of the top face 40 will be a pair of parallel flanges 54 and 56, best shown in FIGS. 4, 8, 17, 18, and 27. The flanges 54 and 56 are of a lesser thickness than the top member, so that the flanges are slightly pliable. The pliability of the flanges 54 and 56 allows the housing member 32 to be inserted into a cutout and form a friction fit with the walls or edges of the cutout. This allows the housing member to snap-fit into place. Additionally, to aid in the pliability of the flanges 54 and 56, each flange optionally has a channel 58 and 60, which extends the length of the flange. These flanges ensure the housing member will frictionally fit into the cutout in a door or window without requiring the use of bolts or rivets to ensure stability of the housing member. Weatherstripping material could also be used. The weatherstripping material can be attached to each side of the top face 40 in place of flanges 54 and 56.

In one embodiment, a pair of opposed side walls 46 and 48 are attached integrally to the top 40 and bottom members 44, FIGS. 8, 9, 17, 18, 19, and 27. Each side wall includes a slot 62 and 64 for receiving and holding the bolt 34. The slots 62 and 64 of the side walls 46 and 48 are aligned. Additionally, each side wall 46 and 48 optionally includes a hole 66 and 68, with the two holes aligned. The holes 66 and 68 receive and hold a pivot pin (not shown) on which the handle member 36 is attached and rotates. Attached to one side wall 48 is a U-shaped member 70, which extends the length of the side wall and top member. The U-shaped member 70 has two legs 72 and 74 and a base 76. One leg 72 of the U-shaped member 70 is attached to the top member 40, with a channel or shaped recess 78 formed by the U-shaped member 70. More particularly, a shaped recess is formed by the U-shaped member. The other leg 74 of the U-shaped member extends away from the side wall 48, and is intended to engage one of the walls that form the cutout. The channel or shaped recess 78 is included so that the housing member 32 can slide to one side of the cutout, thereby creating enough space to insert the other side of the housing member into the cutout. The housing member 32 is then moved back towards the original position and snapped into place to form a friction fit with the wall of the cutout.

The other side wall 46 includes an integral foot or shoulder 80, which projects out, away from the side wall, FIGS. 8, 17, 18, and 27. The foot 80 forms a ledge 82, which helps to cause the friction fit. The foot or shoulder 80 extends the length of the side wall. As such, the ledge 82 and one of the legs 74 of the U-shaped member 70 engage the walls of the cutout of the member in which the latch assembly is inserted. When the leg 74 engages one of the walls of the cutout, the channel 78 continues to receive part of that same wall. Meanwhile, the flanges 54 and 56 also engage the walls on opposite sides and, thereby, a friction fit between the handle assembly and the cutout of the door or window is formed.

Figure 7:
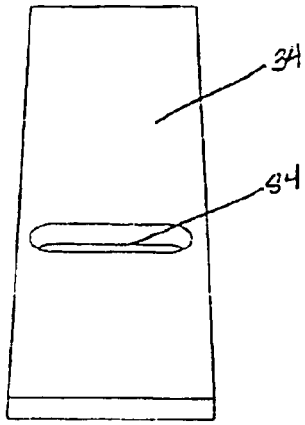
FIG. 7 is a side perspective view of the bolt member.
Figure 8:
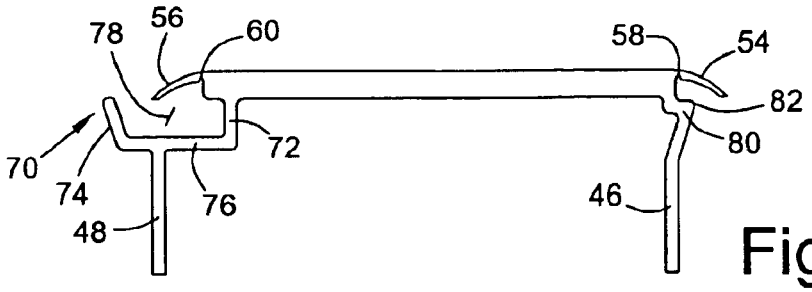
FIG. 8 is a back cutaway perspective view of the housing member.

The bolt member 34, shown in FIG. 7, is preferably of a rectangular construction and has a notch or hole 84 for receiving part of the transfer cam 38. The bolt 34 is slideably received by the two slots 62 and 64 located in the side walls 46 and 48, and is located in a plane perpendicular to the side walls. The bolt 34 holds the door or window closed and, when moved, allows the door or window to be opened. The bolt can be made from any of a variety of rigid materials, including plastic, wood, metal, and any other type of rigid material. Further, the bolt can have numerous end configurations. The notch 84 is located within the interior of the bolt. The notch 84 should be of a size or dimension that the transfer cam 38 engages the wall that forms the notch and moves along the wall, as the bolt is moved in one direction or another. The notch must be of a length so that the transfer cam can slide along one of the edges that forms the notch. Alternative constructions to the rectangular bolt may be used, as long as the bolt can be moved to open and close the door, and allows for the transfer cam to actuate the bolt by moving in conjunction with the bolt. Thus, the bolt can work by moving in either a linear or rotary motion.

Figure 6:
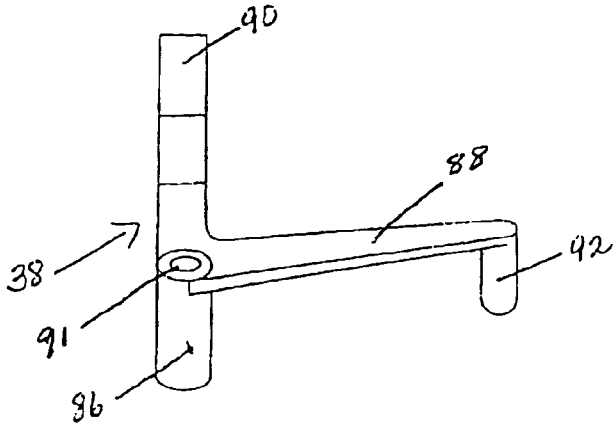
FIG. 6 is a side perspective view of the transfer cam.
Figure 20:
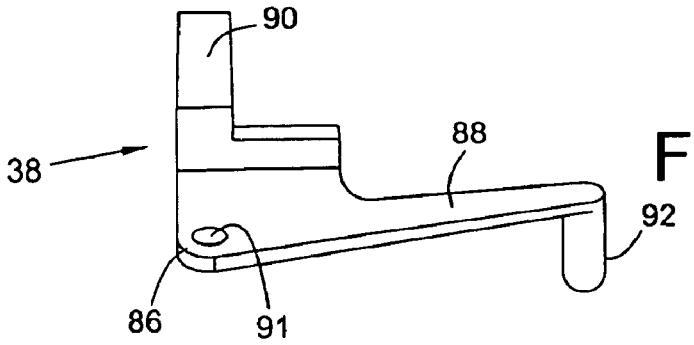
FIG. 20 is a side perspective view of an alternative embodiment of the transfer cam.

The transfer cam 38, shown in FIGS. 6 and 20, is designed to transfer motion from the handle 36 to cause the bolt 34 to move. Any device can be used, which will allow for the transfer of motion, as long as the handle 36 can be actuated, and the bolt 34 can be moved. In one embodiment, the transfer cam 38 translates the rotary motion of the handle into linear motion of a bolt. Another embodiment has the transfer cam transferring the rotary motion from the handle to the rotary motion of a bolt. The transfer cam 38 can include a hollow cam member 86, as shown in FIG. 6, through which a pin 37 passes, as shown in FIG. 3, and on which the motion is translated.

Figure 21:
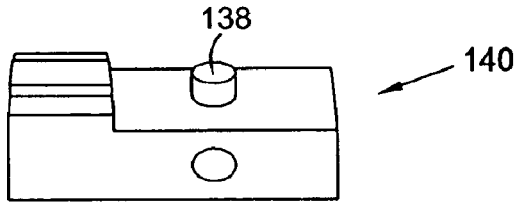
FIG. 21 is a side perspective view of the rectangular rod member containing the pivot point.
Figure 22:
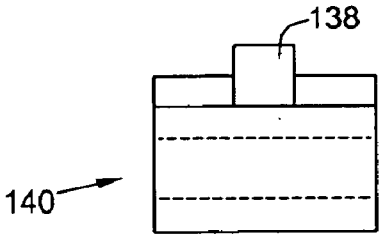
FIG. 22 is a back perspective view of the rectangular rod member.
Figure 23:
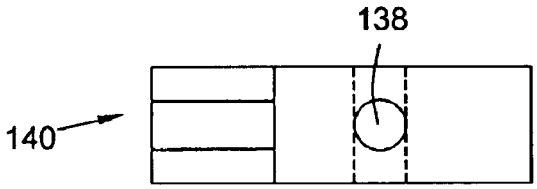
FIG. 23 is a top view of the rod member.
Figure 24:
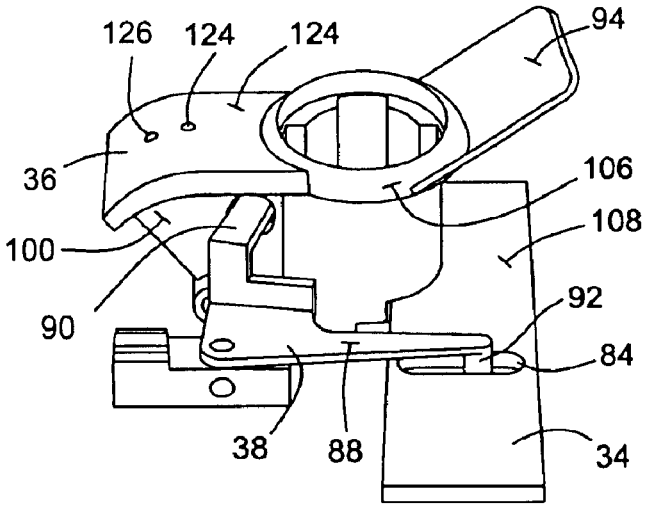
FIG. 24 is a side perspective view of an alternative embodiment of the handle member, transfer cam, bolt member, and rectangular rod member.
Figure 25:
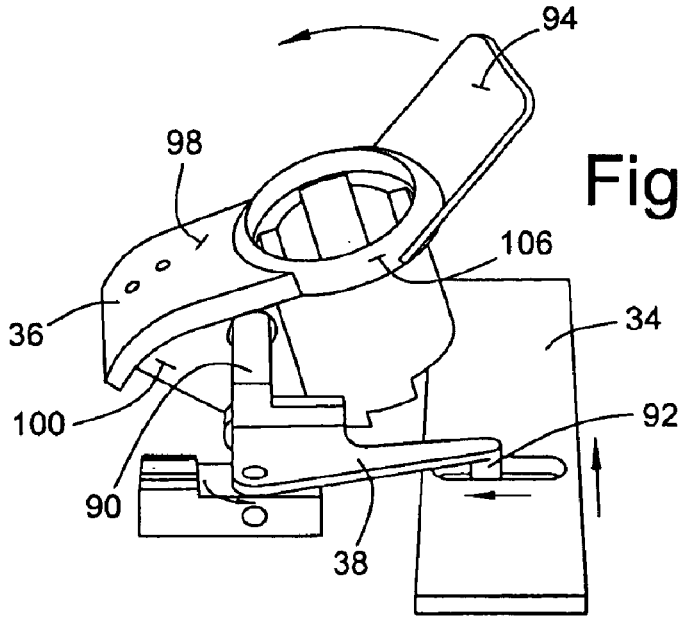
FIG. 25 is a side perspective view showing the motion of the handle member, relative to the transfer cam, bolt member, and rectangular rod member.
Figure 26:
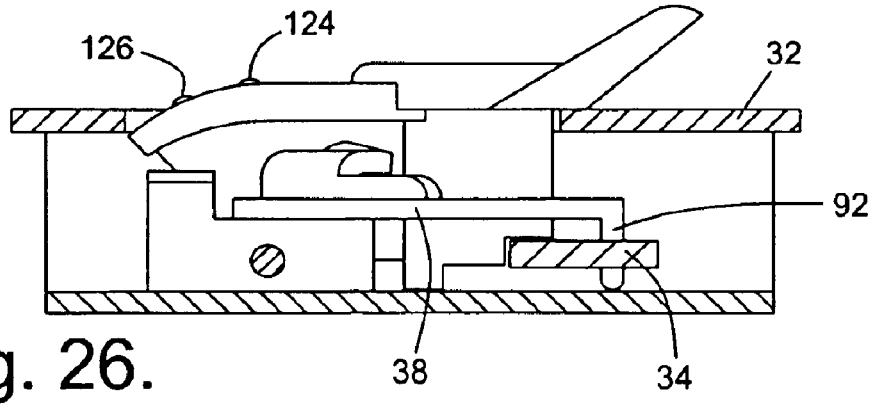
FIG. 26 is a side cutaway view of an alternative embodiment of the latch assembly; and, FIG. 27 is a back cutaway view of an alternative embodiment of the latch assembly.
Figure 27:
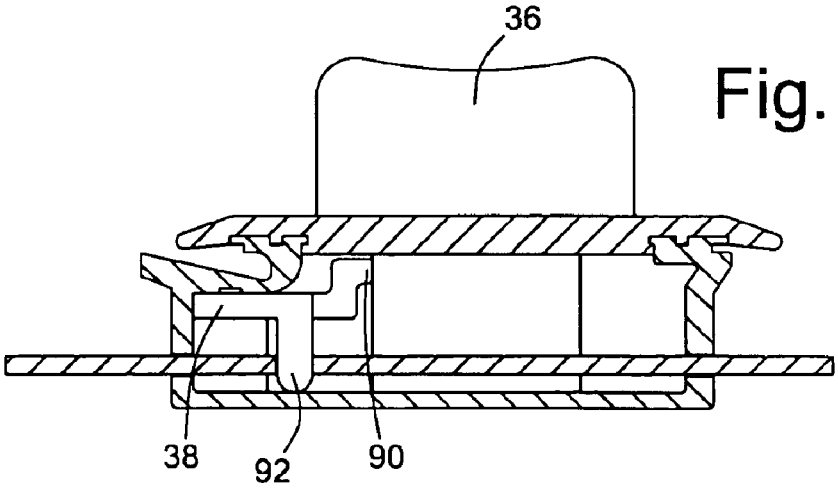

The embodiment of the transfer cam, shown in FIG. 6, shows the hollow cam member 86, through which a pin passes, is cylindrical. The pin passes through the hole 91 in the cam member. In the embodiment of the transfer cam 38 shown in FIG. 20 the cam member 86 is flat, a pivot point is received into hole 91 on the cam member 86. In this embodiment, hole 91 of the cam member fits over a pivot point 138 integrally attached to a block member 140, shown in FIGS. 21–23. The block member provides a base on which the cam can rotate. Additionally, it has a hole for receipt of a rod or pin, on which the handle rotates. Importantly, the block eliminates wasted motion by making the cam and handle rotation points specifically perpendicular. The interaction of the transfer cam, block member, bolt, and handle is shown in FIGS. 24 and 25.

A pair of legs or shaft members 88 and 90 are integrally attached to the cam member 86, and are located at a position essentially perpendicular to the cam member. The legs or shaft members 88 and 90 are oriented approximately at a 90° angle to one another and, more specifically, 85° angle, to one another. The shaft members 88 and 90 are more specifically referred to as the bolt leg 88 and stepped leg 90. The bolt leg 88 is attached on one end to the cam member 86, and on an opposite end, it is received by the bolt member 34. The bolt leg 88 will include a ball-ended member 92, which is received by the slot or notch 84 of the bolt. The other leg 90 is known as the stepped leg, because it is of a "stepped" construction. Part of the stepped leg 90 is in a different plane than the remainder of the leg. This is important to transfer the force from one plane to another. The transfer cam 38 preferably is of a unitary integral construction.

The handle 36, shown in FIGS. 5, 10, 11, 12, 14, 24, and 25 is preferably of an extruded, unitary construction, and is most preferably made of hard plastic. Any of a variety of devices or members can be used as the latch 36, as long as it can pivotally rotate, house a tumbler lock 128, and can receive and actuate the transfer cam 38. The preferred latch member includes a handle 94, a tumbler housing 96, a leg 98, curved on one end, a wall 100 perpendicular to the leg, a pivot point tube 102, and a cutout 104 for receiving part of the transfer cam. When the latch member 36 is actuated, it is moved in a rotary motion, FIGS. 11 and 25.

The handle 94 of the handle member 36 can be any of a variety of constructions, as long as it allows for the latch member to be gripped and pulled, or actuated, by a user. Preferably, the handle 94, when in position, projects up and away from the housing member 32. The handle 94 can be of any of a variety of constructions, including a rectangular, square, or circular-type construction.

Figure 5:
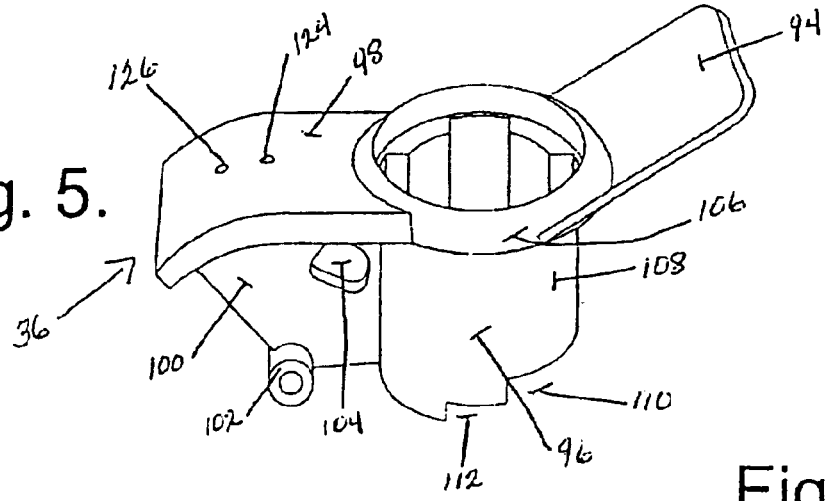
FIG. 5 is a side perspective view of the handle member.
Figure 10:
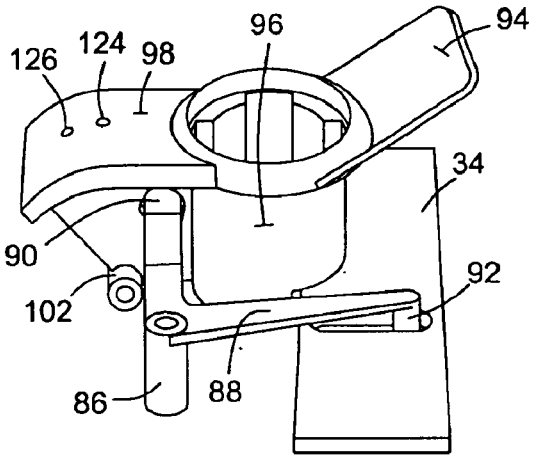
FIG. 10 is a side perspective view of the handle member, transfer cam, and bolt member.

Affixed to the handle 94 of the latch member 36 will be a tumbler housing 96, shown in FIGS. 5, 10, and 14. The tumbler housing 96 will generally be of a cylindrical construction, because this is the shape of a typical tumbler. The shape of the tumbler housing 96 will be at least partially determined by the shape of the tumbler. The tumbler housing 96 will have a top 106, FIG. 16, and a body 108. The top 106 of the tumbler housing 96 is an outside lip, which is of a greater diameter than the body 108 of the tumbler housing.

Located opposite the lip 106, the tumbler housing 96 will have a pair of stepped cutaways 110 and 112. The first cutaway portion 110 is designed to pass over the bolt 34 so that part of the tumbler housing and the bolt are located proximal to one another, which is partially shown in FIG. 3. The cutaway is L-shaped.

A typical tumbler will have a pair of feet, or similar flange members, which will engage the bottom of the tumbler housing to secure the tumbler within the housing. The second cutaway 112 is designed so that the feet of the tumbler can extend outward and be engaged by part of the bottom of the tumbler housing 96. The remaining portion of the tumbler body 108 will rest on the bottom 44 of the housing member 32. Also located on the bottom of the tumbler housing will be a deflect member 114, best shown in FIG. 11. The deflect member 114 can be depressed or moved out of position so that the tumbler housing can be engaged by the deflect to hold it in place.

The interior of the tumbler housing 96 will be designed so that it will receive and hold a tumbler member. In particular, located near the bottom of the tumbler housing will be a pair of lips or ledges 116 and 118 designed to receive the tumbler, whereby the tumbler may rest thereupon. The interior of the housing will also have at least two slots 120 and 122 that receive part of the tumbler and prevent extraneous movement of the tumbler within the tumbler housing. The remainder of the inside wall of the tumbler housing will preferably be curved.

Integrally attached to the tumbler housing 96, opposite the handle 94, will be a leg 98. The leg 98 will be curved on an end opposite the tumbler housing. Preferably, a pair of bumps or protrusions 124 and 126 will be located on the outer surface of the leg to hold the handle in an "up" or "down" position. As such, the bumps 124 and 126 will contact the edge of the slot 42 of the housing member. Affixed to the leg 98 and the tumbler housing 96 will be a wall member 100. Located within the wall 100 will be a hole 104, designed and dimensioned to receive the transfer cam 38. The hole 104 is of such a construction that not only does it receive the transfer cam, but it is designed to minimize rotary force vectors and maximize linear force vectors in conjunction with the profiles on the transfer cam. As can be seen in FIGS. 5 and 14, the hole 104 is typically not of a circular construction, but of a rounded square construction.

Figure 11:
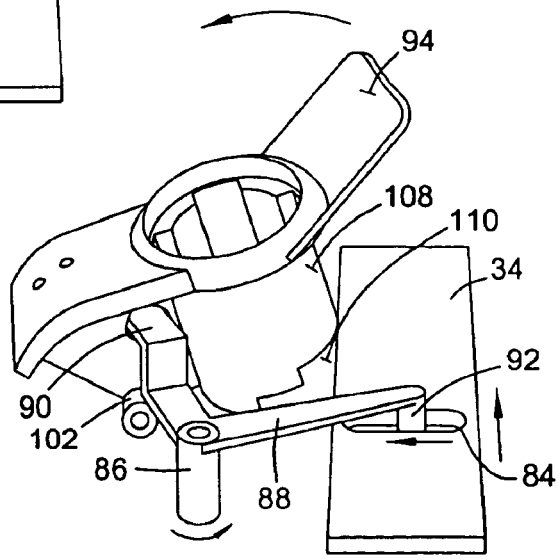
FIG. 11 is a side perspective view showing the motion of the handle member relative to the transfer cam and bolt member.

Affixed to the wall 100 opposite the leg 98 will be a pivot point tube 102. The pivot point tube 102 is what the handle 36 pivots on and holds the handle in place. A pin is rotatably affixed to the holes 66 and 68 located in the side wall of the housing member, allowing the handle to pivotally rotate on the pin. As such, when the handle member is actuated, it will rotate on the pivot point tube, which will, in turn, cause the transfer cam to be actuated and to cause movement of the bolt member. The motion of the handle 36, in conjunction with the transfer cam 38 and the bolt 34, is best shown in FIGS. 11 and 25. The three members are also shown in a stationary position in FIGS. 10 and 24.

It is preferred to have a tumbler lock member 128, FIG. 15, placed within the confines of the handle 36. Specifically, the tumbler lock 128 will be located in the tumbler housing 96, FIG. 16. Preferably, the tumbler lock 128 is of a substantially cylindrical construction so that it is easily placed within the tumbler housing 96. Additionally, the tumbler lock 128 will include at least one projection, which is designed to be received by either spaces 120 or 122 in the tumbler housing. The tumbler lock 128 includes a lip 130 attached to the lock body 132. The lock body 132 will house the locking mechanism and prevent the actuation of the handle member when in a locked position. Attached to the bottom of the tumbler lock will be a foot 134. The foot is designed to be received by the cutaway 112 and to pass under a portion of the bolt 34. Thus, the foot 134 and the cutaway on the bottom of the tumbler housing will form a space, which allows for movement of the bolt back and forth. Located on the bottom of the lock body 132 and opposite the foot 134 will be a projection member 136. The projection member is received and held by the deflect 114 to further anchor the locked tumbler within the confines of the tumbler housing. While the described tumbler lock is preferred, any locking mechanism may be used that allows for the handle member to be adequately locked so that it cannot be actuated to, in turn, move the latch member.

Thus, there has been shown and described a latch assembly insert product, which fulfills all the objects and advantages sought therefor. It is apparent to those skilled in the art, however, that many changes, variations, modifications, and other uses and applications for the latch assembly product are possible, and also such changes, variations, modifications, and other uses and applications which do not depart from the spirit and scope of the invention are deemed to be covered by the invention, which is limited only by the claims which follow.

What is claimed is:

1. A latch assembly insert, comprising:

a housing member having a top member with an opening, a base member, and a pair of opposed side walls attached to said top member and said base member, said top member having a pair of parallel flanges, said base member having a pair of holes, and each side wall having an aligned slot, said housing member designed to be snap-fit into a space;

a bolt slideably received by said side wall slots, said bolt having a slot;

a latch member comprising a handle, a tumbler housing, a leg that is curved on one end, a wall perpendicular to said leg, and a pivot point tube attached to said wall; and, a transfer cam received by said latch member, said transfer cam comprising a cam member and a pair of cam legs attached to said cam member, one of said cam legs of said transfer cam is received by the slot in said bolt, so that when said handle is actuated, said transfer cam is actuated to cause movement of said bolt.

2. The latch assembly of claim 1, wherein said latch member includes a tumbler lock located in said tumbler housing.

3. The latch assembly of claim 1, wherein said handle is made of a rigid material.

4. The latch assembly of claim 1, wherein the opening in said top member is a slot.

5. The latch assembly of claim 1, wherein said housing member has a U-shaped member attached at its base to one of said side walls and, on one leg, to said top member, whereby said U-shaped member facilitates said latch assembly being snap-fit into a space.

6. The latch assembly of claim 5, wherein said housing member has a foot attached to the other side wall, said foot forms a ledge which extends along the entire side wall.

7. The latch assembly of claim 2, wherein said tumbler housing has a first cutaway so that said tumbler housing fits over said bolt, and a second cutaway to hold said tumbler lock in place.

8. The latch assembly of claim 1, wherein one of said side walls is U-shaped.

9. The latch assembly of claim 1, wherein one of said side walls has a projection which forms a ledge.

10. The latch assembly of claim 1, wherein said top member is integrally attached to said side walls.

11. The latch assembly of claim 1, wherein said tumbler housing has a cutaway to fit over said bolt.

12. The latch assembly of claim 1, wherein each of said pair of parallel flanges includes a channel extending the length of said flange.

13. The latch assembly of claim 1, wherein said top member is removably attached to said side walls.

14. The latch assembly of claim 10, wherein said latch member does not include a base member.

15. The latch assembly of claim 13, wherein said base member is integrally attached to said side walls.

16. The latch assembly of claim 13, wherein said top member is slideably attached to said side walls.

17. The latch assembly of claim 1, wherein said housing member is made of material chosen from the group consisting of plastic, metal, wood, and combinations thereof.

* * * * *